United States Patent [19]

Poulsen et al.

[11] 4,439,870

[45] Mar. 27, 1984

[54] X-RAY SOURCE AND METHOD OF MAKING SAME

[75] Inventors: Martin E. Poulsen, New Providence; Frederick Vratny, Berkeley Heights; Alfred Zacharias, Plainfield, all of N.J.

[73] Assignee: Bell Telephone Laboratories, Incorporated, Murray Hill, N.J.

[21] Appl. No.: 334,479

[22] Filed: Dec. 28, 1981

[51] Int. Cl.[3] ..... H01J 35/08

[52] U.S. Cl. ..... 378/143; 378/130; 378/141

[58] Field of Search ..... 378/143, 130, 200, 141, 378/144; 313/35

[56] References Cited

U.S. PATENT DOCUMENTS 4,258,262 3/1981 Maldonado ..... 378/200 X

FOREIGN PATENT DOCUMENTS 53-102690 7/1978 Japan ..... 378/143

*Primary Examiner*—Eugene R. LaRoche
*Assistant Examiner*—Vincent De Luca
*Attorney, Agent, or Firm*—Lucian C. Canepa

[57] ABSTRACT

It has been discovered that the diffusion of hydrogen species into the outside or water-cooled surface of a pure palladium anode included in an X-ray source causes various deleterious effects. To avoid these effects, a limited-depth hydrogen-barrier layer made, for example, of $Pd_3Sn$ is formed within the anode extending from the outside surface thereof. The inside or target surface and a major extent of the palladium anode remain virtually unaffected during the forming step. The desired palladium emission characteristic of the anode is thereby preserved. In practice, the modified anode remains free of hydrogen and, as a result, exhibits a particularly advantageous long-life property. Such an anode constitutes an important part of a high-power X-ray lithographic system adapted for making VLSI devices.

9 Claims, 3 Drawing Figures

X-RAY SOURCE AND METHOD OF MAKING SAME

BACKGROUND OF THE INVENTION

This invention relates to the generation of X-rays and, more particularly, to an improved X-ray source and to a method for fabricating such a source.

X-ray generators are utilized in a variety of applications of practical importance. One significant area in which such sources are employed is the field of X-ray lithography. An illustrative X-ray lithographic system utilized to make structures such as very-large-scale-integrated (VLSI) semiconductor devices is described in an article by M. M. Lepselter, "Scaling the Micron Barrier With X-Rays," *Technical Digest* 1980 *IEDM,* page 42. An advantageous water-cooled X-ray source for inclusion in such a system is specified by J. R. Maldonado, M. E. Poulsen, T. E. Saunders, F. Vratny and A. Zacharias in "X-Ray Lithography Source Using a Stationary Solid Pd Target," *J. Vac. Sci. Technol.,* Vol. 16, page 1942 (1979). Such a source is also described in U.S. Pat. No. 4,258,262.

Continuing efforts have been directed by workers in the X-ray field at trying to improve the palladium target described in the aforementioned references. In particular, these efforts have been concerned with trying to devise an especially rugged high-power palladium target characterized by excellent stability, long lifetime and low maintenance. It was recognized that an X-ray source including such a target could be an important basis for realizing a rugged production-type X-ray lithographic system exhibiting advantageous characteristics.

SUMMARY OF THE INVENTION

Hence, an object of the present invention is a high-power X-ray source that exhibits advantageous stability, lifetime and maintenance characteristics. More specifically, an object of this invention is a high-power X-ray source, having a stationary palladium target, exhibiting the aforespecified characteristics and especially adapted for use in an X-ray lithographic system.

Briefly, these and other objects of the present invention are realized in a specific illustrative X-ray source that comprises a hollow-cone target anode made of palladium. Incident electrons are directed to bombard a portion of the inside surface of the cone. X-rays emitted from the cone irradiate the entirety of a VLSI mask which is positioned in a spaced-apart relationship with respect to a device substrate coated with an X-ray-sensitive resist material. The cone is cooled by establishing along the outside surface thereof a water flow characterized by nucleate boiling.

Applicants discovered that in a system including a source that comprises a water-cooled palladium anode hydrogen diffuses into the outside surface of the anode. In turn, applicants determined that such hydrogen diffusion causes various deleterious effects which significantly degrade the desired characteristics of the source and ultimately of the entire overall system. In particular, hydrogen diffusion often results in substantially curtailing the useful life of the X-ray source.

In one specific illustrative embodiment of applicants' invention, a limited-depth hydrogen-barrier layer is formed within the palladium anode extending from the outside (or water-cooled) surface thereof. The inside (or target) surface as well as a major interior portion of the palladium anode remain virtually unaffected during the forming step. The desired X-ray emission; characteristic of a palladium anode so modified is thereby preserved. In practice, the modified anode remains free of hydrogen and, as a result, exhibits a particularly advantageous long-life property.

In accordance with a specific feature of applicants' invention, the aforespecified hydrogen-barrier layer is formed by depositing on the outside surface of the palladium anode a layer of a material selected from the group consisting of tin, lead, silicon and germanium. The target with the deposited layer is then heated to a temperature and for a time sufficient to cause the material to diffuse primarily into a limited-;depth region of the target directly below the outside surface. In that way, a hydrogen-barrier layer constituting a compound of the deposited material and palladium is formed in the anode.

BRIEF DESCRIPTION OF THE DRAWING

A complete understanding of the present invention and of the above and other features thereof may be gained from a consideration of the following detailed description presented hereinbelow in connection with the accompanying drawing, in which.

DETAILED DESCRIPTION

For purposes of a specific illustrative example, emphasis herein will be directed to a particular embodiment of applicants' invention that comprises an X-ray source included in an X-ray lithographic system. But it is to be understood that a high-power source made in accordance with applicants' inventive principles is also adapted for use in a variety of other applications of practical importance including, for example, diffraction studies, radiography and tomography.

Figure 1:
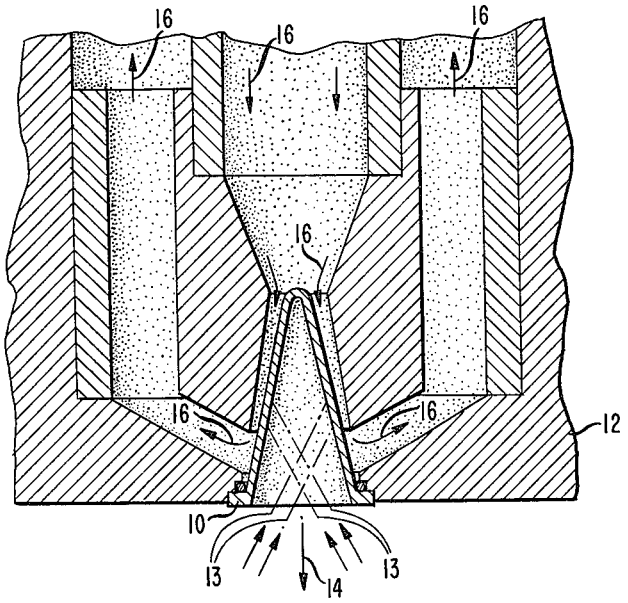
FIG. 1 (PRIOR ART)
FIG. 1 is a cross-section representation of a water-cooled stationary target anode of a conventional type known in the art.

An X-ray lithographic system of the type described in the aforecited references includes a stationary water-cooled target anode. Such a known anode 10 is shown in FIG. 1. Illustratively, the anode 10 of FIG. 1 comprises a hollow cone made of pure or substantially pure palladium having a wall thickness in the range of 200 to 350 micrometers. The anode 10 is mounted, for example by brazing, in a circular opening in a cylindrical metallic housing 12.

Electrons, designated by dot-dash lines 13 in FIG. 1, are directed from a standard ring cathode (not shown in the drawing—see U.S. Pat. No. 4,258,262) to impinge upon a portion of the inside surface of the conical anode 10. In response to bombardment by electrons, the anode 10 emits X-rays that propagate downwards in FIG. 1 centered about longitudinal axis 14 to irradiate the upper surface of a conventional X-ray mask structure (not shown—see U.S. Pat. No. 4,258,262).

Cooling of the standard conical anode 10 shown in FIG. 1 is carried out by directing a flow of water through passageways in the housing 12 along the outside surface of the anode 10, as described in detail in the aforecited U.S. Pat. No. 4,258,262. In FIG. 1, arrows 16 represent the direction of flow of the cooling water.

In the course of developing a high-power target anode for X-ray lithography, applicants observed that the life-time characteristic of a structure of the type shown in FIG. 1 was frequently in practice less than that required to serve as a basis for an economical and rugged production-type X-ray system. In the course of their development, applicants discovered that a primary cause of the failure of degradation in performance of such an anode arose from the introduction of hydrogen into the palladium cone from and through the outside of water-cooled surface thereof.

Applicants determined that some; of the X-rays emitted from the target anode 10 of FIG. 1 interact with the water utilized to cool the anode 10. In particular, X-rays directed into the cooling water cause a dissociation of some of the water, thereby to form free hydrogen species. In turn, on the outside surface of the anode 10, an $H_2$ species forms. Some of the $H_2$ species diffuses into the conical anode 10 along crystalline boundaries of the palladium material. The hydrogen thus introduced into the anode 10 forms a compound of hydrogen and palladium which causes significant internal stresses to be established in the palladium crystalline structure. This typically leads to mechanical distortions and physical deformities in the configuration of the anode, particularly at the relatively high temperatures encountered during high-power operation of the system. Fissures, brittle fractures and cracks in the anode structure often result. As a consequence, the mechanical integrity of the structure is impaired, hot spots frequently develop therein and, in practice, premature failure of the anode sometimes occurs.

In addition, hydrogen species diffusing through the entire thickness of the palladium cone can enter the high-vacuum region established within the interior of the conical anode. This, in turn, can lead to substantial degradation in the specified operating characteristics of the system.

In accordance with the principles of the present invention, a standard X-ray target anode is modified to form an effective hydrogen-barrier layer therein. The initial step in applicants' procedure for modifying the anode is illustrated in FIG. 2.

Figure 2:
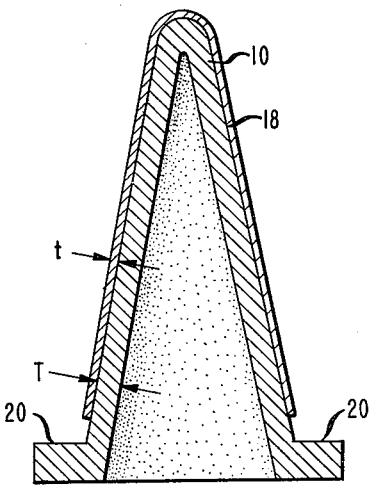
FIG. 2 depicts a partially fabricated target anode having a layer deposited on the outer surface thereof in accordance with a feature of the principles of the present invention.

In FIG. 2, a deposited layer 18 is shown on a major portion of the outside surface of the previously described palladium anode 10. Illustratively, the layer 18 is made of a material selected from the grdup consisting of tin, lead, silicon and germanium.

In accordance with a feature of the principles of the present invention, the layer 18 (FIG. 2) is preferably made of tin. For a target anode having a thickness T in the range 200 to 350 micrometers, a layer 18 of tin approximately 10-to-25 micrometers thick is deposited on the outside surface only of the cone 10. Such a layer of tin can be formed thereon in a variety of standard ways known in the art.

One illustrative way in which to form a layer of tin on the cone 10 of FIG. 2 is by plating. In preparation for the plating step, the cone 10 is typically first chemically cleaned, for example in ethylene dinitrilo tetra acetic acid (EDTA), then in a mixture of ammonium chloride and hydrochloric acid and again in EDTA. Thereafter, all surfaces of the cone 10 except those on which the layer 18 is to be deposited (see FIG. 2) are masked or otherwise protected to avoid plating tin thereon. Then, plating of the cone is carried out in, for example, a standard tin fluoroborate bath. The cone is connected to the negative terminal of a direct-current source. A wire (made, for example, of platinum) immersed in the bath and encircling the cone is connected to the positive terminal of the source. A current flow of about 3-to-10 milliamperes per square centimeter of the cone area to be plated is then established in the bath. By way of a specific example, in approximately 30 minutes at a current flow of 10 milliamperes per square centimeter, a 15-micrometers-thick layer of tin in granular form was deposited on the cone 10, as represented in FIG. 2.

Thereafter, the tin-plated cone is removed from the aforespecified bath, rinsed in deionized water and dried. Without the aforenoted plating mask thereon, the plated cone appears as shown in FIG. 2. Portions of the cone that were masked, including an annular ledge surface 20, remain unplated. The ledge surface 20 and a lower side portion of the cone are to be secured, for example by brazing, to the aforementioned housing 12.

Subsequently, the plated cone of FIG. 2 is placed in, for example, a vacuum furnace at a pressure of $10^{-5}$ Torr or less. Illustratively, the temperature in the furnace is brought up to a final value in the range of 650-to-1300 degrees Celsius over a period of 2-to-3 hours. (In one specific example, a final-value temperature of 1100 degrees Celsius was reached in 2 hours.) The mounted cone is typically left in the oven at the final-value temperature for approximately 3-to-4 hours. Alternatively, heating can be carried out in a standard furnace at a temperature in the range of 650-to-1300 degrees Celsius over a period of 2-to-3 hours in an atmosphere of an inert gas such as argon or nitrogen.

During the aforespecified heating or annealing step, any hydrogen that might have been present in the palladium structure of the cone is driven therefrom. Further, during the heating step, major portions of the tin initially plated on the surface of the cone diffuse into a limited-depth subsurface portion of the cone and form therein an alloy or a compound or compounds of tin and palladium (in particular, $Pd_3Sn$). The formerly plated surface of the cone is left in its initially smooth state, which facilitates the flow of cooling water therealong when the modified target is utilized in a high-power X-ray source.

Some of the plated tin volatilizes during the aforespecified heating step. Additionally, some tin moves along palladium grain boundaries and actually reaches the inside surface of the cone. But, later, during cleaning and still later during initial electron bombardment and heating, tin is effectively removed from the inside surface of the cone to a depth of at least 1 micrometer. Moreover, the area of these grain boundary appearances at the inside surface of the cone are insignificant relative to the bulk surface area of the palladium. For these reasons, incident electrons directed at the inside surface will "see" only pure palladium.

Figure 3:
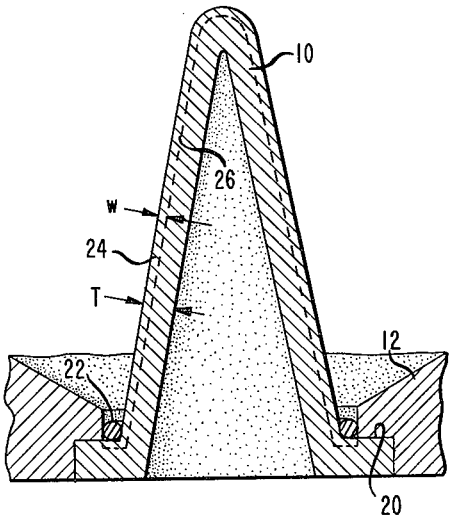
FIG. 3 shows a fully fabricated target anode having a hydrogen-barrier layer formed therein in accordance with this invention.

In one specific illustrative example in which the initial thickness t (FIG. 2) of the plated tin layer was about 10 micrometers and the thickness T (FIG. 2) of the palladium cone 10 was about 350 micrometers, the thickness w (FIG. 3) of the aforespecified subsurface layer was approximately only 0.1-to-10 micrometers (depending on temperature and time). This subsurface layer, which is indicated in FIG. 3 by reference numeral 24, extends between the outside surface of the conical target 10 and a boundary within the target represented by dashed-line 26. (So as not to unduly clutter the drawing and because, as indicated above, its effect is negligible, no grain-boundary tin is depicted in FIG. 3.)

The limited-depth layer 24 shown in FIG. 3 constitutes in practice an effective barrier against the introduction of hydrogen into the target 10 from the outside or water-cooled surface thereof. Significantly, this hydrogen-barrier layer is stable and in practice does not interact in any discernible deleterious way with the water utilized to cool the target during extended high-power operation thereof.

Importantly, the inside surface and a substantial sub-inside-surface portion of the target 10 shown in FIG. 3 remain virtually unaffected during the previously described procedure in which the hydrogen-barrier layer 24 is formed. Accordingly, as indicated above, electrons directed at the inside surface of the target "see" only pure palladium. Hence, the desired X-ray emission characteristic of a pure palladium target remains unaffected by applicants' hydrogen-barrier-layer-forming procedure.

After being annealed, as described, the cone 10 is then typically cleaned. Illustratively, this involves lightly abrading the ledge portion and the lower side portion of the cone in preparation for brazing. Also, the outside surface of the cone is typically chemically cleaned by dipping the cone in EDTA and in ammonium chloride and hydrochloric acid. The cleaned cone is then rinsed in deionized water.

At that point, the cone 10 is placed in a suitable standard fixture and mounted in position on the housing 12. Illustratively, a brazing ring 22 made, for example, of a conventional nickel-gold alloy (such as Nioro brazing material made by Englehard Industries, Newark, N.J.) is interposed between the cone 10 and the housing 12, as shown in FIG. 3.

Brazing is carried out in, for example, a vacuum furnace at a pressure of about $10^{-5}$ Torr. Illustratively, a temperature of about 1000 degrees Celsius for approximately 30 minutes is effective to accomplish brazing. Subsequently, additional cleaning of the cone is done. This includes lightly abrading the outside surface of the cone with alumina followed by chemical cleaning by dipping in EDTA and Triton-X (made by Rohm and Haas, Philadelphia, Pa.). The cleaned cone is then rinsed in deionized water. At that point, the mounted cone is ready for installation in an X-ray system.

As described above, a tin layer 18 (FIG. 2) can be deposited on the outside surface of the target 10 in a plating step. But, in accordance with the principles of the present invention, the tin layer can be formed in a variety of other standard ways known in the art. Thus, for example, a layer of the type described earlier above can be formed on the outside surface of the target by applying tin thereto in its molten state. Alternatively, a suitable layer of tin can be formed thereon in a conventional sputtering operation or by standard chemical-vapor-deposition (CVD) techniques.

Moreover, in accordance with applicants' invention, materials other than tin are suitable for application to the outside surface of the target 10 (FIG. 2) to form the layer 18. These materials, each deposited to form a layer having a thickness t of 1-to-30 micrometers, comprise lead (applied by plating, sputtering or CVD) and silicon or germanium (applied by standard plasma-spray techniques, sputtering or CVD). After deposition, each of these other materials is made to diffuse into the target and to form a limited-depth hydrogen-barrier layer therein. This is done, for example, in a heating step in a vacuum furnace (or in an inert gas atmosphere) in accordance with the same procedure specified above for tin.

Finally, it is to be understood that the above-described arrangements are only illustrative of the principles of the present invention. In accordance with those principles, numerous modifications and alternatives may be devised by those skilled in the art without departing from the spirit and scope of the invention.

What is claimed is:

1. In combination in an X-ray system, a target comprising an X-ray-emissive material for producing X-rays in response to electron bombardment of surface portions of said target, and means for directing cooling water along other surface portions of said target, wherein the improvement comprises a limited-depth hydrogen-barrier layer, comprising said X-ray-emissive material as a constituent, formed within said target extending from said other surface portions.

2. A combination as in claim 1 wherein said target is made of palladium and said layer comprises a compound of palladium and a material selected from the group consisting of tin, lead, silicon and germanium.

3. A combination as in claim 2 wherein said compound comprises $Pd_3Sn$.

4. A combination as in claim 3 wherein said target comprises a hollow conical member, wherein said surface portions constitute a relatively small-area portion of the inside surface of said member, wherein said other surface portions constitute a relatively large-area portion of the outside surface of said member, and wherein the thickness of said hydrogen-barrier layer is only about ten percent of the total thickness of said member.

5. In combination in a long-life high-power X-ray lithographic system adapted to fabricate VLSI devices, a hollow conical member that comprises an inside surface that includes target regions designed to be bombarded by incident electrons and that includes an outside surface to be cooled, said member including a limited-depth hydrogen-barrier layer extending into said member from said outside surface, the remainder of said member being made of substantially pure palladium, said layer being made of a compound of palladium and tin, and means for directing a flow of cooling water along a substantial extent of said outside surface.

6. A method of fabricating an X-ray source comprising the steps of forming a target member that includes surface regions comprising an X-ray-emissive material designed to be bombarded by incident electrons and other surface regions designed to be cooled by a flow of water therealong, and, in a limited-depth portion within said target member extending from said other surface regions, forming a hydrogen-barrier layer that comprises said X-ray-emissive material as a constituent.

7. A method of fabricating an X-ray source comprising the steps of forming a target member that includes surface regions designed to be bombarded by incident electrons and other surface regions, designed to be cooled by a flow of water therealong, and, in a limited-depth portion within said target member extending from said other surface regions, forming a hydrogen-barrier layer, wherein said first-recited forming step comprises forming a hollow conical target member made of palladium, said other surface regions constituting a major portion of the outside surface of said conical member, and wherein said second-recited forming step comprises depositing on said other surface regions a layer of tin, and heating said member with said layer thereon to a temperature and for a time sufficient to cause said tin to diffuse into a limited-depth region of said member directly below said other surface regions to form in said region a hydrogen-barrier layer constituting a compound of palladium and tin.

8. A method as in claim 7 wherein said member has a thickness of approximately 300 micrometers, said layer of tin is deposited on said other surface regions to a thickness of approximately 10 micrometers, said member with said tin layer is heated to a final-value temperature of approximately 1100 degrees Celsius over a period of approximately 2 hours and is held at the final-value temperature for approximately 3½ hours, whereby the depth of the hydrogen-barrier layer so formed is approximately 10 micrometers.

9. A method of sealing a hollow X-ray-emissive cone made of substantially pure palladium to render a limited-depth region directly below the outer surface of said cone impervious to hydrogen migration, said method comprising the steps of depositing on said outer surface a layer of a material selected from the group consisting of tin, lead, silicon and germanium, and heating said cone with said layer on the outer surface thereof to a temperature and for a time sufficient to cause said material to diffuse entirely into a limited-depth region of said cone directly below said outer surface to form in said region a hydrogen-barrier constituting a compound of said material and palladium.

* * * * *